United States Patent [19]

Janke et al.

[11] Patent Number: 5,012,560

[45] Date of Patent: May 7, 1991

[54] COUPLING PIECE AND A METHOD FOR CONNECTING CONTAINERS

[75] Inventors: Thomas Janke, Bremen; Johannes Wielenberg, Oyten-Bassen, both of Fed. Rep. of Germany

[73] Assignee: Conver-OSR Ozean Service-Reparatur-Ingenieurtechnik GmbH, Bremen, United Kingdom

[21] Appl. No.: 321,150

[22] Filed: Mar. 9, 1989

[30] Foreign Application Priority Data

Jul. 29, 1988 [DE] Fed. Rep. of Germany ... 8809688[U]

[51] Int. Cl.[5] ..... B65D 21/02

[52] U.S. Cl. ..... 24/287

[58] Field of Search ..... 411/349, 350, 549, 552, 411/553, 554; 24/590, 591, 595, 453, 286, 287, 288; 403/348, 316, 317; 74/567; 410/107, 111

[56] References Cited

U.S. PATENT DOCUMENTS

| | | | |
|---|---|---|---|
| 3,578,374 | 5/1971 | Glassmeyer | 24/287 X |
| 3,753,272 | 8/1973 | Laidley | 24/287 |
| 4,082,052 | 4/1978 | Looks | 24/287 X |
| 4,564,984 | 1/1986 | Takaguchi . | |
| 4,732,505 | 3/1988 | Gloystein | 403/348 X |
| 4,782,561 | 11/1988 | Hayama | 24/287 |

FOREIGN PATENT DOCUMENTS

| | | |
|---|---|---|
| 2110716 | 10/1971 | Fed. Rep. of Germany . |
| 2204915 | 2/1972 | Fed. Rep. of Germany . |
| P370419 | 10/1988 | Fed. Rep. of Germany . |
| 2084265 | 12/1971 | France . |

OTHER PUBLICATIONS

"Automatic Container Lashing Fitting", Shipbuilding and Shipping Record, Oct. 16, 1970, p. 48.

*Primary Examiner*—Rodney M. Lindsey
*Assistant Examiner*—Jerry Redman
*Attorney, Agent, or Firm*—Burns, Doane, Swecker & Mathis

[57] ABSTRACT

A coupling piece for releasably connecting adjacent containers includes a housing, a rotatable locking bolt positioned within the housing, a rotatable actuating lever mounted in the housing and a spring device connected to the locking bolt for normally urging the locking bolt in a locking direction. The locking bolt has a crossbar located at each end thereof that is insertable into an opening in the adjacent containers. A portion of the actuating lever engages the locking bolt so that upon rotation of the actuating lever in a first direction, the locking bolt is rotated in a releasing direction which is opposite to the locking direction.

21 Claims, 9 Drawing Sheets

COUPLING PIECE AND A METHOD FOR CONNECTING CONTAINERS

FIELD OF THE INVENTION

The invention relates to a method and a coupling piece for connecting containers and more particularly, to a method and a coupling piece; for connecting corner fittings of adjacent containers, especially containers stacked above one another on ships.

Background of the Invention

Coupling pieces of the type in question here, called "Twistlock" in the specialized jargon, are used predominantly during the transport of containers on ships. The coupling pieces are intended for reliably preventing shifts of the containers relative to the ship on the one hand and relative to one another on the other hand.

The invention starts from a coupling piece, such as is described, for example, in German Offenlegungsschrift 2,204,915, in particular a so-called three-function twistlock. In this coupling piece, the mutually opposite crossbars are arranged on the locking bolt with an angular offset relative to one another and can be brought into three different coupling positions. In a released position, with the lower crossbar prelocked, the upper crossbar is in an open position for insertion into the lower corner fitting of an upper container. After insertion into the corner fitting of the upper container, the coupling piece is prelockable, with the upper crossbar prelocked and the lower crossbar open. In this position, the upper container can be introduced, together with the coupling piece, into a corresponding upper corner fitting of a lower container. The crossbars can then be brought into their locking position, in which the two containers are connected by means of the coupling piece.

A disadvantage of this known coupling piece is that manual intervention is necessary several times in order to fit it and remove it, first with respect to the prelocking of the coupling piece and second with respect to for the final locking after the containers have been placed on one another. The last locking step in particular presents special difficulties in practice, because it has to be carried out after the containers have been stacked on one another and, according to experience, access to the coupling pieces has become more difficult. Furthermore, the final locking of the coupling pieces involves danger to the person entrusted with this, because, to do this, he has to climb onto or between several container stacks.

Objects and Summary of the Invention

The object on which the invention is based is to provide a coupling piece and a method for releasing and locking the coupling piece between corner fittings of adjacent containers, guaranteeing at a low outlay in terms of manual labor a reliable connection between containers stacked on one another.

To achieve this object, the coupling piece according to the invention includes a locking bolt that is spring prestressed. The spring prestress of the locking bolt ensures that the final locking of the coupling piece takes place automatically after the containers have been placed on one another. Thus, in contrast to the coupling piece according to German Offenlegungsschrift 2,204,915, there is no longer any need for manual intervention for the final locking of the coupling pieces after the containers have been placed on one another.

Appropriately, the locking bolt is prestressed by means of at least one spring arranged between the latter and the housing. At the same time, the arrangement of the spring is such that it is completely prestressed when the coupling piece is released and, after the insertion of the coupling piece, as a result of its prestress the spring rotates the locking bolt into the locking position, at the same time being braced on the housing.

The coupling piece according to the invention also has an actuating lever arranged on the locking bolt. However, in contrast to the three-function coupling piece according to German Offenlegungsschrift 2,204,915, this actuating lever can be brought into only two different end positions, in particular into a releasing position and a locking position. There is therefore no (central) prelocking position, thereby also simplifying the operation of the coupling piece according to the invention. To make it possible, nevertheless, to obtain a prelocking of the coupling piece on the lower corner fitting of the upper container, the releasing position coincides with the prelocking position. When the actuating lever is in the releasing position, the upper crossbar is therefore always in the prelocking position, whilst the lower crossbar is in a released position as a result of its offset relative to the upper crossbar.

Moreover, according to the invention, the actuating lever is designed differently from that of German Offenlegungsschrift 2,204,915 and is mounted in the housing. For this, the actuating lever of the coupling piece according to the invention has a (central) axle portion which is mounted rotatably in the housing with a longitudinal axis directed transversely relative to the longitudinal midaxis of the locking bolt. Thus, in contrast to known coupling pieces of this type, the actuating lever is not arranged directly on the locking bolt.

A rotation of the locking bolt by means of the actuating lever takes place via a switch cam arranged on the end of the axle portion located in the housing. This switch cam is designed as an elongate switch nose which extends transversely relative to the longitudinal axis of the axle portion. As a result of this design of the actuating lever, during a rotation of the actuating lever about its axle portion the switch nose is pivoted out of a direction in which it is parallel to the longitudinal mid-axis of the locking bolt and into a direction in which it is transversed relative to this longitudinal mid-axis. Because of this design of the actuating lever, when the latter swings round, the locking bolt rotates by means of the switch nose which is arranged in it and which engages positively into a correspondingly designed switch slot in the locking bolt. When the actuating lever is shifted round from the locking position into the releasing position, that is to say during the release of the coupling piece, as a result of the rotation of the locking bolt occurring thereby, the spring is tensioned at the same time. During the pivoting of the actuating lever in the opposite direction, that is to say from the releasing position into the locking position, however, there is no positive takeup of the locking bolt. On the contrary, when the actuating lever is in the locking position, the locking bolt is rotatable automatically into the locking position by means of the spring or several springs, as required.

According to a further proposal of the invention, at least the lower crossbar on the locking bolt is equipped with a helically wound cone, as a result of which this crossbar can be introduced automatically into a corresponding corner fitting of the container to be connected, even when it is in its locking position.

In an advantageous development of the invention, the actuating lever is spring-loaded in the locked direction, preferably by means of a torsion spring mounted on the axle portion. This ensures that the actuating lever cannot pass automatically into the releasing position.

A substantial improvement in terms of a proper lashing of containers is afforded by a coupling piece having the features of the present invention as well. The indicator tongue movable to and fro as a function of the position of the crossbars makes it possible to see whether the crossbars are in a locking position or a releasing position. From the position of the indicator tongue, it is therefore possible, after the containers have been loaded, to ascertain whether the crossbars are in the desired locking position.

Appropriately, the indicator tongue is mounted displacably in the housing of the coupling piece. In a preferred embodiment of the invention, this mounting is such that, when all the crossbars are in a locking position, the indicator tongue is located completely in the housing, that is to say is not visible. In contrast, when at least one crossbar is not in a locking position, the indicator tongue protrudes at least partially from the housing, with the result that it can be ascertained reliably that there has been no connection of adjacent corner fittings of two containers by means of the particular coupling piece. Alternatively, the mounting of the indicator tongue in the housing can also be such that the indicator tongue protrudes from the housing when the crossbars are completely locked and disappears in the housing, that is to say is invisible, when locking is incomplete.

Preferably, the indicator tongue is moved to and fro by means of the locking bolt serving for actuating the two crossbars. For this purpose, the indicator tongue is connected to the locking bolt by means of a flexible movement member.

A Bowden wire or a rope fastened between the locking bolt on the one hand and the indicator tongue on the other hand can be considered as an actuating member. In an advantageous embodiment of the invention, this rope is guided in an elastically deformable sheathing consisting of a helical spring, a rubber hose or the like, for the accurate transmission of the rotary travel of the locking bolt to the indicator tongue, specifically in opposite directions.

The method for locking the coupling pieces according to the invention is advantageous in that manual intervention is necessary only for prelocking the coupling piece to the lower corner fitting of the upper container. In contrast, the final locking of the two containers takes place without any manual movement of the actuating lever.

The method for releasing the coupling piece according to the present invention is such that; the two containers are initially released in the conventional way, in particular by pivoting the actuating lever out of the locking position into the releasing position. The containers can then be detached, since, when the actuating lever is in the releasing position, the lower crossbar is in a releasing position. To remove the coupling piece from the lower corner fitting of the upper container, the lower crossbar need only be rotated counter to the prestress of the spring, until the upper crossbar comes out of the prelocking position into the releasing position.

BRIEF DESCRIPTION OF THE DRAWINGS

Two exemplary embodiments of the coupling piece according to the invention are explained in detail below by means of the drawing. In this.

DETAILED DESCRIPTION OF THE PREFERRED EMBODIMENTS

Figure 1:
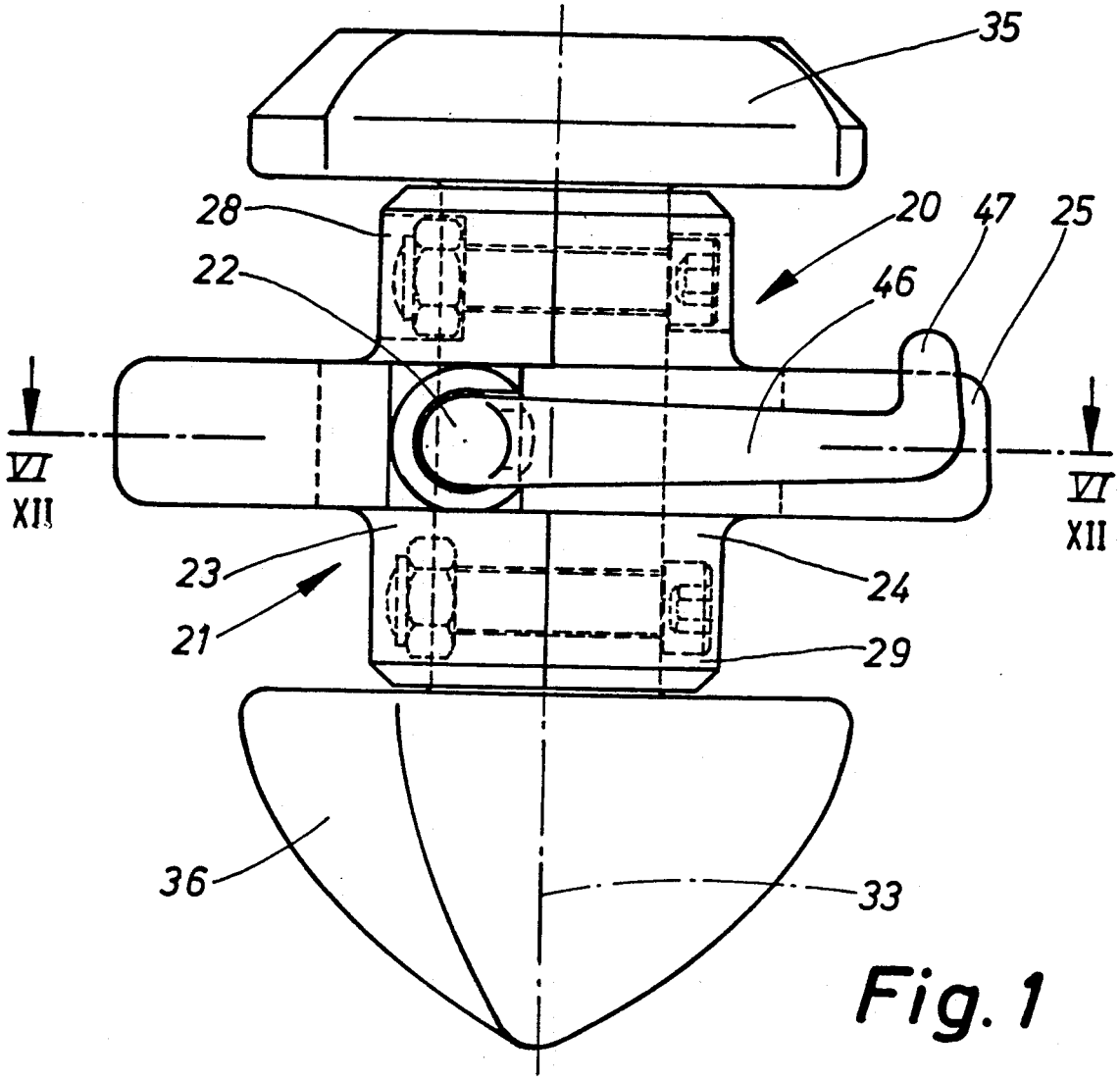
FIG. 1 Shows a side view of the coupling piece (according to a,.first exemplary embodiment)

In the exemplary embodiments illustrated here, the coupling piece comprises a housing 20, a locking bolt 21 and an actuating lever 22. The locking bolt 21 and the actuating lever 22 are mounted rotatably in or on the housing 20.

The housing 20 of the coupling piece is made in two parts, and in particular consists of two housing halves 23 and 24 screwed to one another. The mutually confronting end faces of the housing halves 23 and 24 form a vertical parting plane which divides the housing 20 essentially centrally. The exterior of the housing 20 is subdivided into three portions, in particular a central abutment 25 which, when containers are stacked on one another, comes to rest as a spacer between adjacent corner fittings 26 and 27, and two middle pieces 28 and 29 which are located opposite the abutment 25 and which penetrate into corresponding long holes 30 and 31 in the respective opposite corner fittings 26, 27.

Arranged inside the housing 20 is a vertical continuous housing bore 32, the longitudinal mid-axis 33 of which extends centrally through the housing 20, that is to say coincides with the parting plane formed by the two housing halves 23 and 24. The locking bolt 21 is mounted in the housing bore 32 so as to be rotatable about the vertical longitudinal mid-axis 33.

The locking bolt 21 has a middle part 34 mounted in the housing bore 32 and having, at opposite ends, crossbars 35 and 36 which are located outside the housing 20 and which are rotatable simultaneously with the middle part 34.

Figure 2:
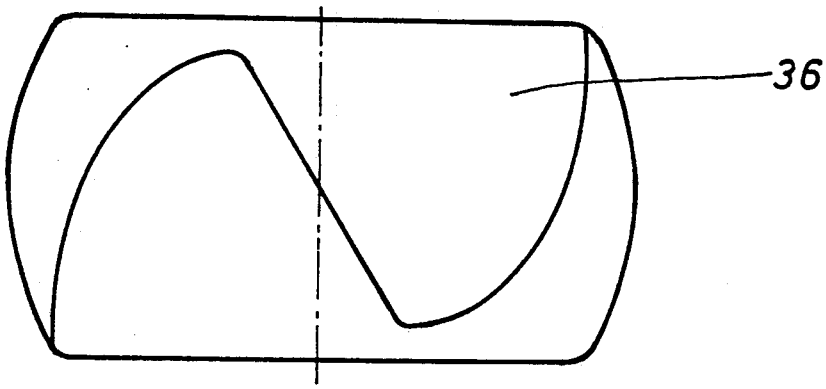
FIG. 2 shows a view from underneath of a lower crossbar of the coupling piece.

The crossbars 35 and 36 have, in horizontal projection, dimensions which correspond approximately to the base area of the middle pieces 28 and 29 of the housing 20, in particular are approximately rectangular and, if required, can be made to coincide with the middle pieces 28 and 29 as a result of an appropriate rotation of the locking bolt 21. Otherwise, the crossbars 35 and 36 are of differing design. The upper crossbar 35 is equipped in a conventional way with bevels extending towards the free end, that is to say is made approximately in the form of a truncated pyramid. According to the invention, the opposite (lower) crossbar 36 is equipped with pronounced roundings towards its free end which are wound helically (FIGS. 1 and 2). Furthermore, the crossbars 35 and 36 are arranged on the middle part 34 with an offset relative to one another which amounts to approximately 60° in the present exemplary embodiment. This ensures that, in the region of the releasing and locking position of the (lower) crossbar 36, the base of the (upper) crossbar 35 cannot coincide with the (upper) middle piece 28 of the housing 20.

Figure 6:
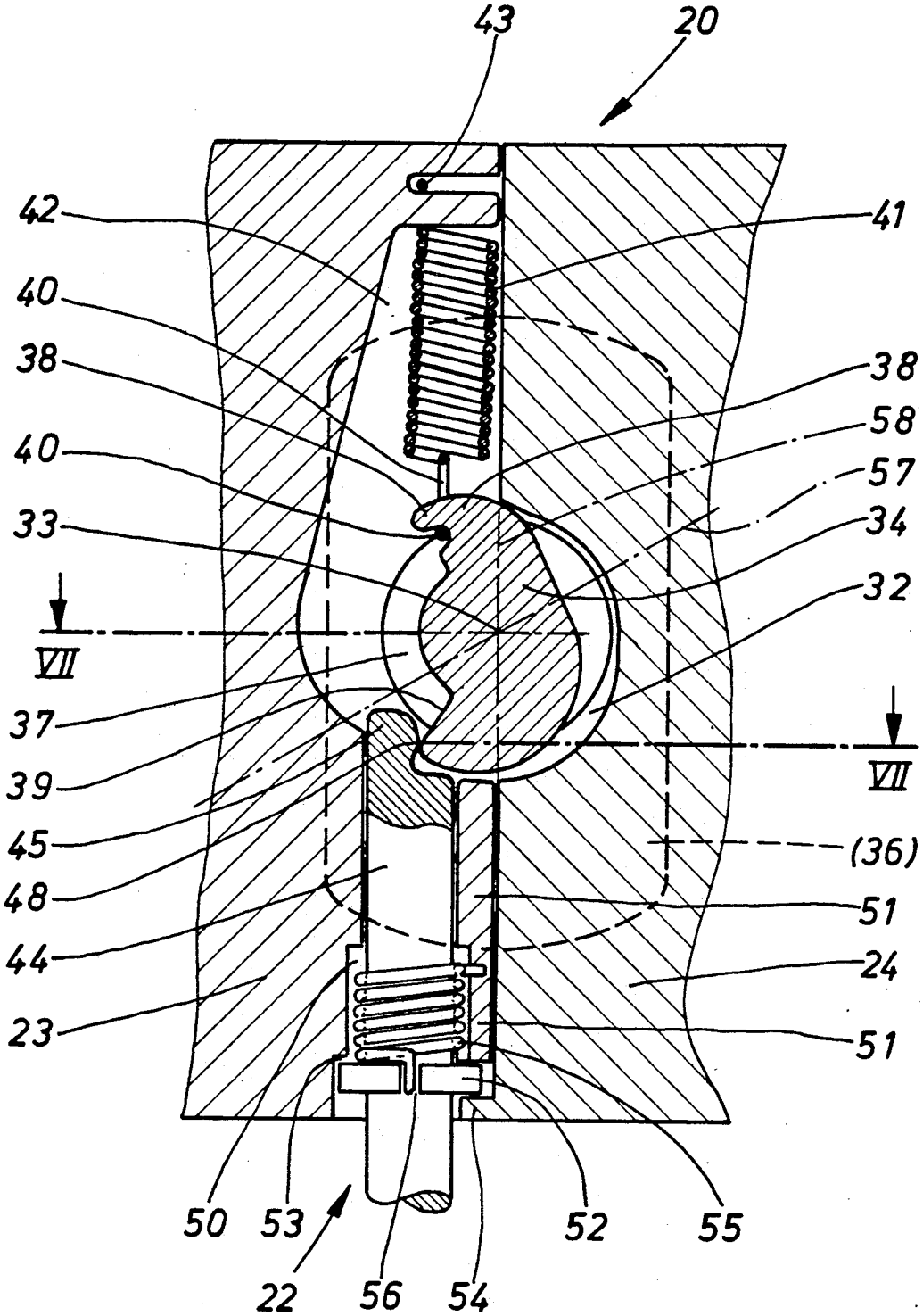
FIG. 6 shows a horizontal section VI—VI through the coupling piece according to FIG. 1.

In the first embodiment of the coupling piece (FIGS. 1 to 11), the locking bolt 21 is equipped, in an approximately central region of the middle part 34, with a contraction in the form of a switch slot 37 and opposite projections 38 and 39 (FIG. 6). The projection 38 on the middle part 34 of the locking bolt 21 serves in this case for receiving one end of a spring, in particular an eye 40 of a tension spring 41. This is arranged transversely relative to the longitudinal mid-axis 33 of the locking bolt 21 in a clearance 42 in one housing half, in particular in the housing half 23, and is anchored to the housing half 23 by means of an opposite eye 43. The second projection 39 of the middle part 34 is in contact with the actuating lever 22 described in detail below.

Figure 10:
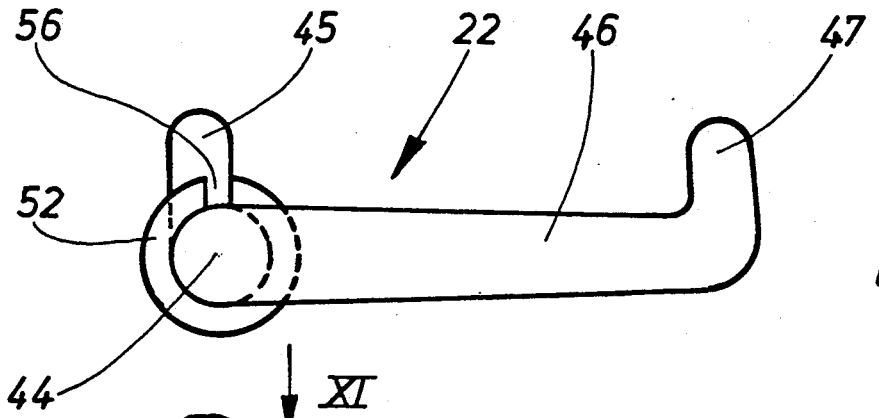
FIG. 10 shows the actuating lever in a view X according to FIG. 9.
Figure 9:
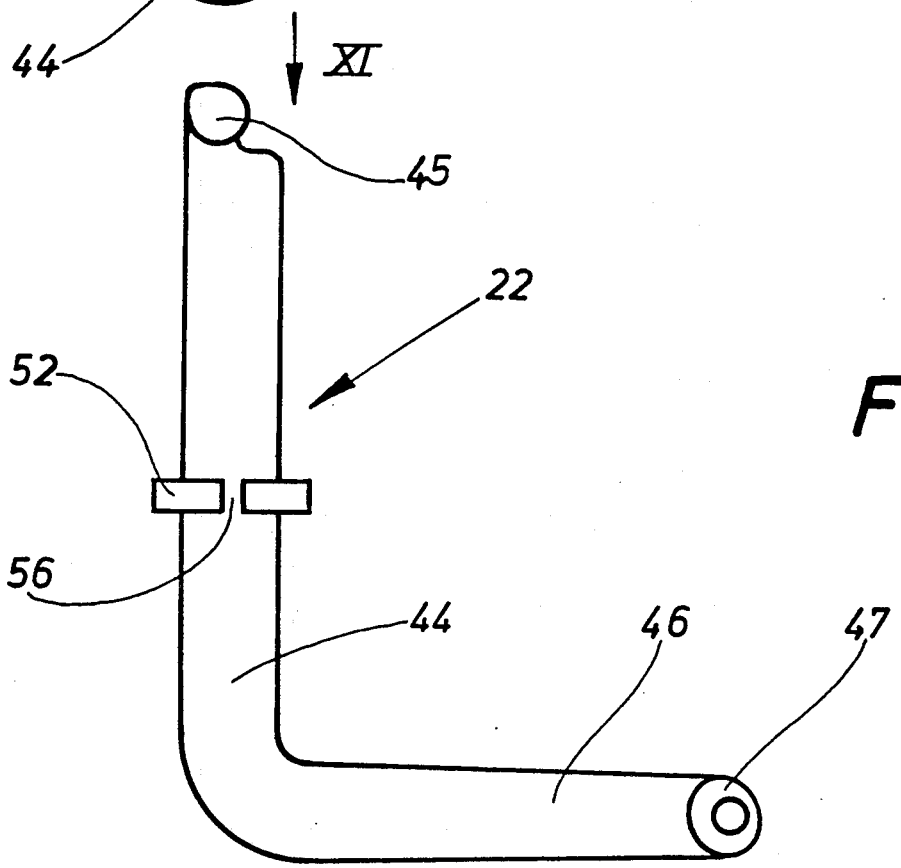
FIG. 9 shows a plan view of an actuating lever.
Figure 11:
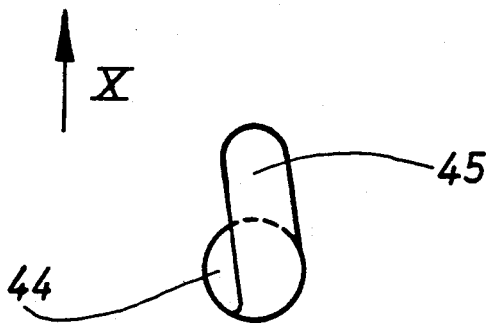
FIG. 11 shows the actuating lever in a view XI according to FIG. 9.

The actuating lever 22 illustrated in detail in FIGS. 9 to 11 has three portions offset relative to one another at approximately 90°, in particular a (central) axle portion 44 serving for mounting the actuating lever 22 in the housing 20, a switch nose 45 adjoining one end of the said axle portion 44, and a handle 46 arranged at the opposite end of the axle portion 44. The switch nose 45 and the handle 46 are angled at approximately 90° relative to the longitudinal direction of the axle portion 44 and are additionally also offset at approximately 90° relative to one another.

Located on the free end of the handle 46 is an angled nose 47 which is intended to make it easier to pivot the actuating lever 22 by attaching a suitable aid to the end nose 47 of the handle 46.

Figure 8:
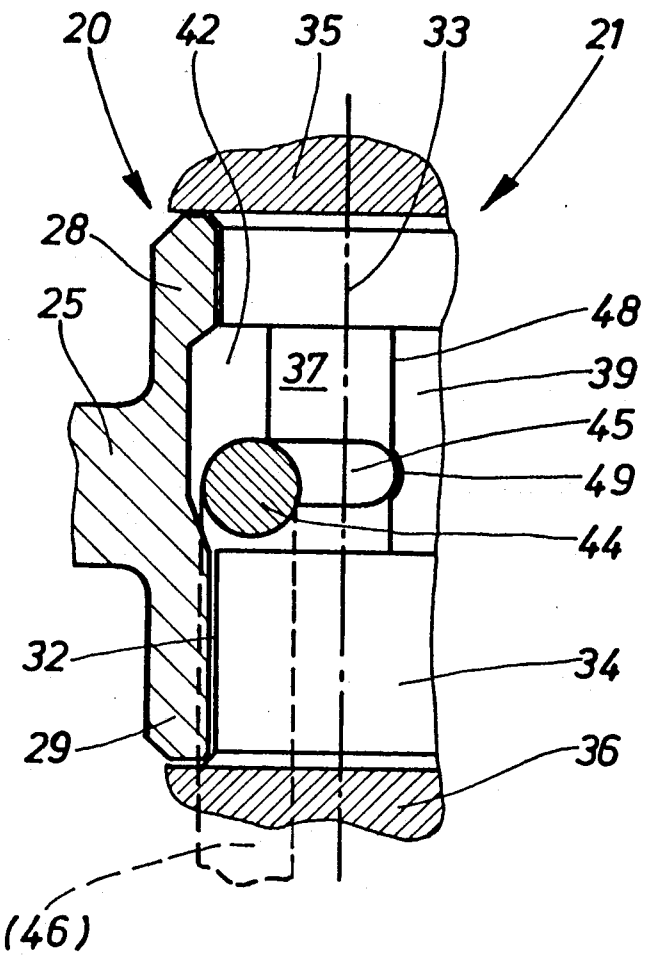
FIG. 8 shows a part section according to FIG. 7, with the locking bolt in the releasing position.
Figure 7:
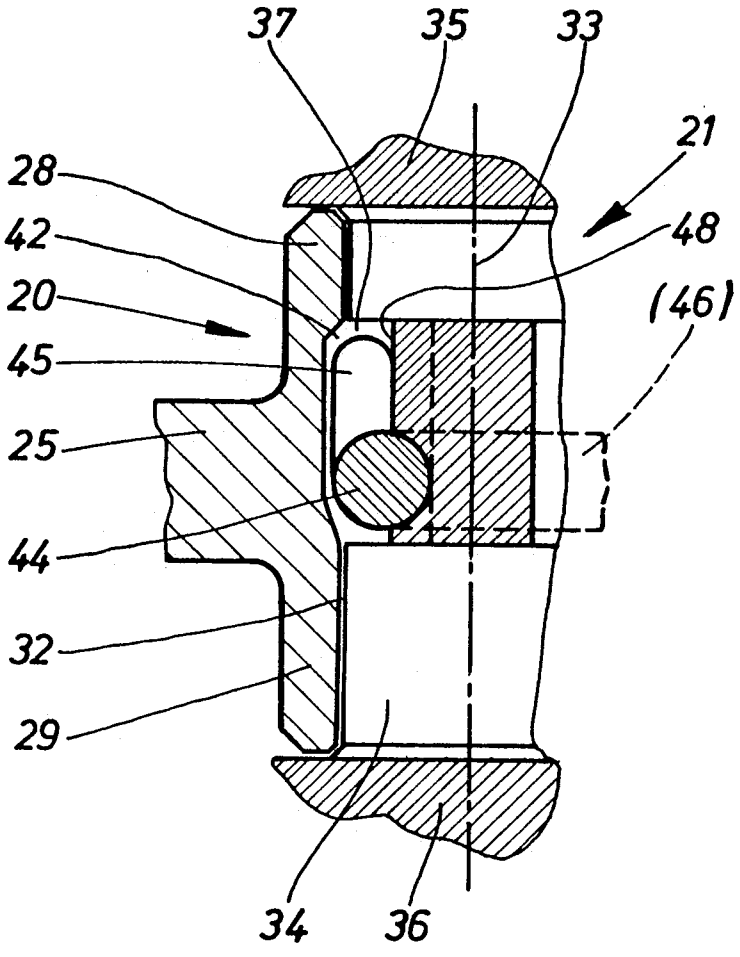
FIG. 7 shows a part section VII—VII, according to FIG. 6, through the coupling piece in the region of a locking bolt which is in the locking position.

The dimensions of the switch nose 45 are such that, in the locking position of the actuating lever 22, it extends approximately parallel to the longitudinal mid-axis 33 of the locking bolt 21, that is to say rests longitudinally against a contact face 48 of the second projection 39 (FIG. 7). In the releasing position of the actuating lever 22, the switch nose 45 assumes an approximately transverse position relative to the longitudinal mid-axis 33 of the locking bolt 21 (FIG. 8). During this pivoting movement of the switch nose 45 from the releasing position into the locking position, it takes up the locking bolt 21 positively for the rotation of the latter.

FIG. 8 also shows a depression 49 which is located in the contact face 48 and into which part of the rounded end of the switch nose 45 engages positively in order to secure the actuating lever 22 in the releasing position.

The actuating lever 22, particularly the axle portion 44 of the latter, is mounted in the housing half 23 of the housing 20. For this purpose, the housing half 23 has a corresponding bearing clearance 50, into which the actuating lever 22 can be inserted by means of its axle portion 44 from the parting plane of the housing 20. The actuating lever 22 is held in the bearing clearance 50 of the housing half 23 by means of a corresponding projection 51 in the parting plane of the opposite housing half 24.

For retention against an axial shift in the bearing clearance 50, the axle portion 44 of the actuating lever 22 is assigned a continuous collar 52 which is held positively between a corresponding limitation of a clearance 53 in the housing half 23 on the one hand and a retaining nose 54 on the housing half 24 on the other hand (FIG. 6).

In the exemplary embodiment shown here, a torsion spring 55 is arranged on the axle portion 44 of the actuating lever 22, one end of the torsion spring 55 being supported on the projection of the housing half 24, whilst the opposite end of the torsion spring 55 is held by means of a bent end in a groove 56 in the collar 52 of the axle portion 44. The spring direction of the torsion spring 55 is selected so that it keeps the actuating lever 22 in the locked position.

The procedure for locking and releasing the coupling piece according to the first exemplary embodiment is explained below by reference to FIGS. 3 to 8. In this explanation, the angles given refer to the relative positions of the crossbars 35 and 36 in relation to the middle pieces 28 and 29 of the housing 20 in respect of the long center lines 57 of the crossbars 35 and 36, on the one hand, and the long center lines 58 of the middle pieces 28 and 29, coinciding approximately with the parting plane of the housing halves 23 and 24, on the other hand. The angles given refer to the present exemplary embodiment of the coupling piece, other angular values being possible in so far as the function of the coupling piece is preserved thereby.

Figure 4:
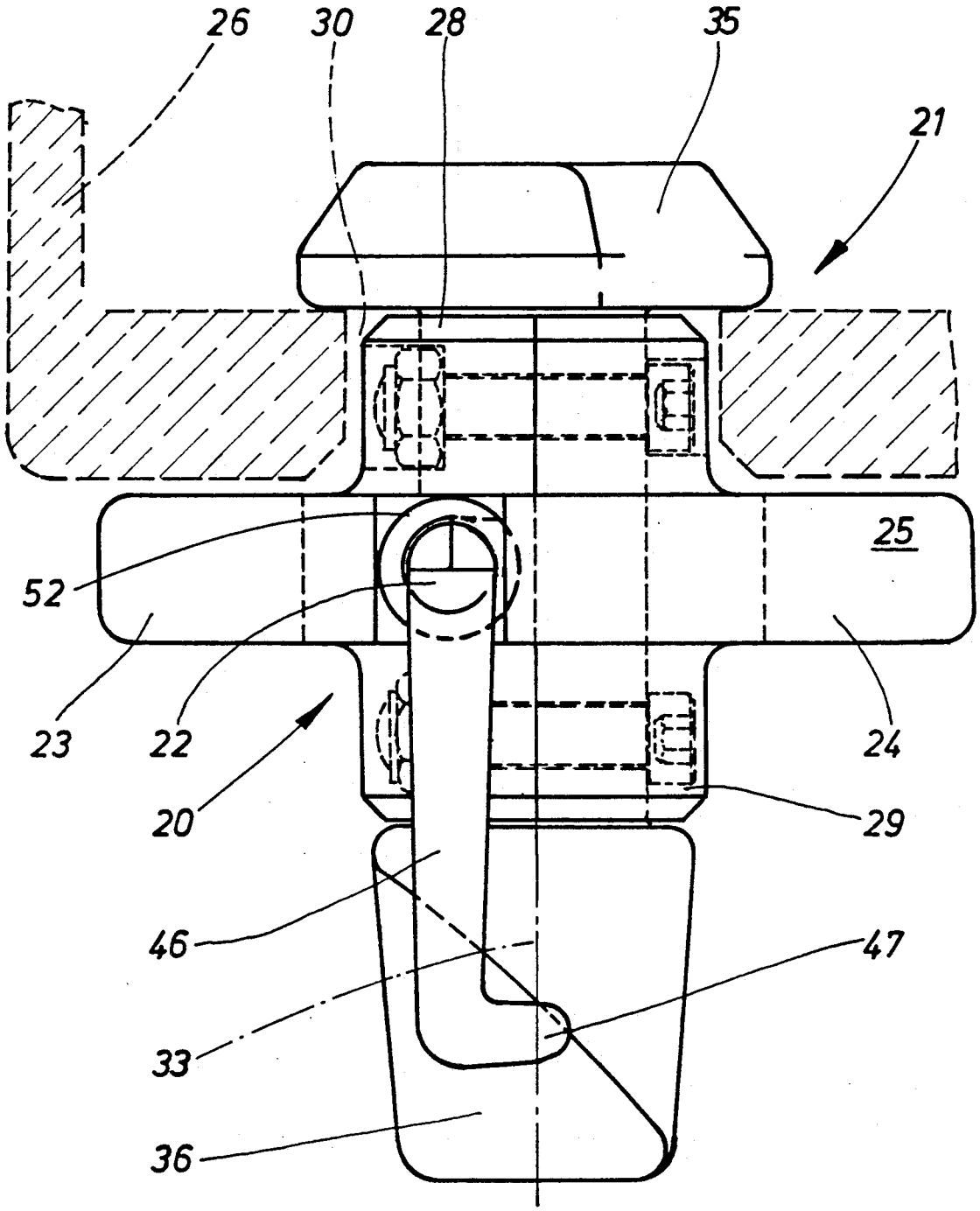
FIG. 4 shows a side view of the coupling piece prelocked to a lower corner fitting of an upper container.
Figure 5:
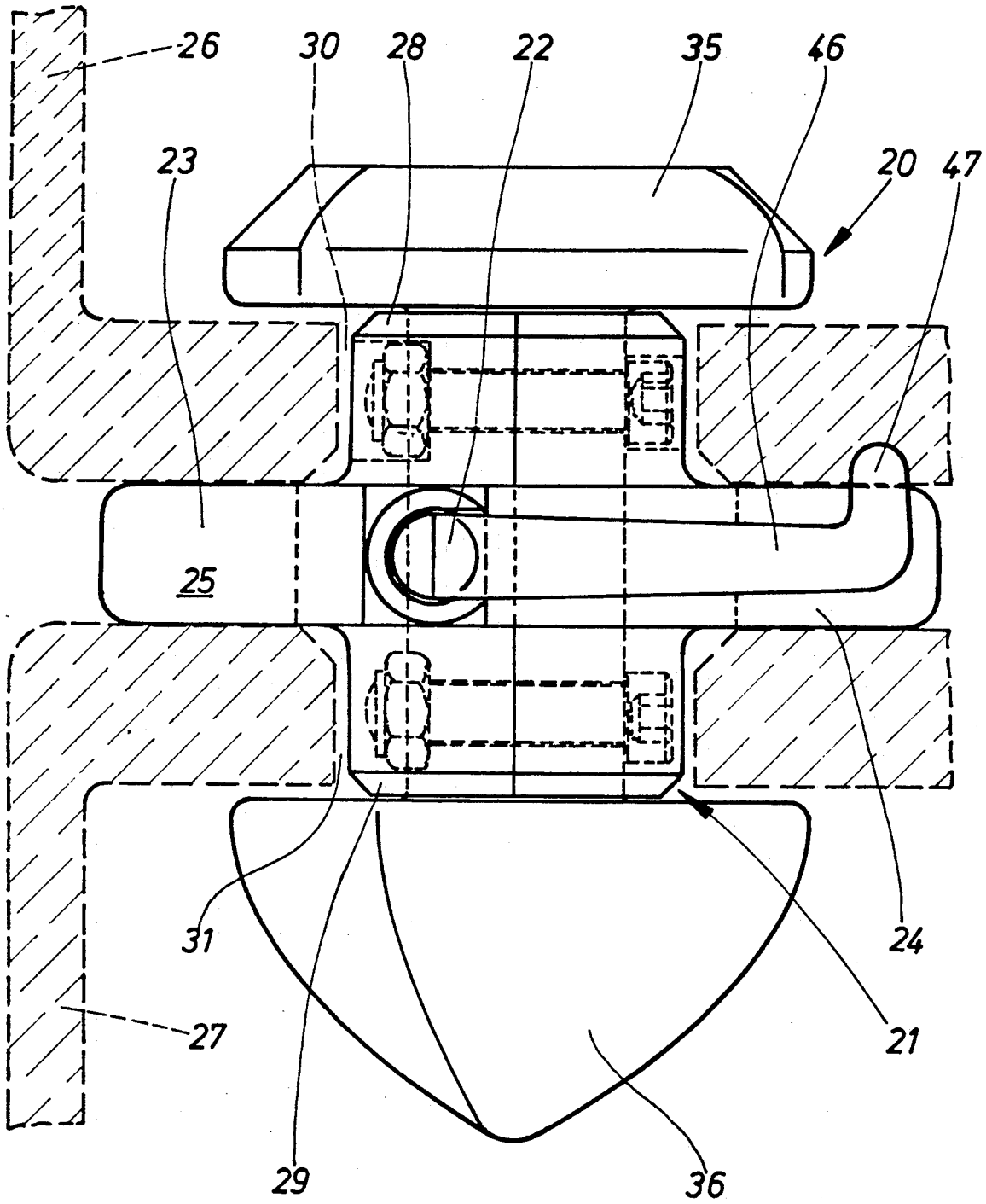
FIG. 5 shows a side view of the coupling piece in the locking position between two adjacent corner fittings of containers placed on one another.

In order to lock the containers, the coupling piece has an initial position shown in FIG. 4. In this position, the handle 46 of the actuating lever 22 is in an approximately vertical position parallel to the longitudinal midaxis 33 of the locking bolt 21. In this released position, the upper crossbar 35 forms an angle of approximately 20° with the middle piece 28, whilst the lower crossbar 36 coincides with the middle piece 29 (0°). Here, the position of the switch nose 45 in the switch slot 37 corresponds to the representation in FIG. 8.

Starting from this, to couple the coupling piece to the lower corner fitting 27 of the upper container, the upper crossbar 35 is made to coincide with the middle piece 28 as a result of the rotation of the locking bolt 21 on the lower crossbar 36. After the coupling piece has been connected to the lower corner fitting 27, the lower crossbar 36 is let go, with the result that the tension spring 41 automatically rotates the locking bolt 21 back into the initial position, in which the upper crossbar 35 forms an angle of 20° with the middle piece 28, whilst the lower crossbar 36 once again comes into coincidence with the middle piece 29, as shown in FIG. 4.

Figure 3:
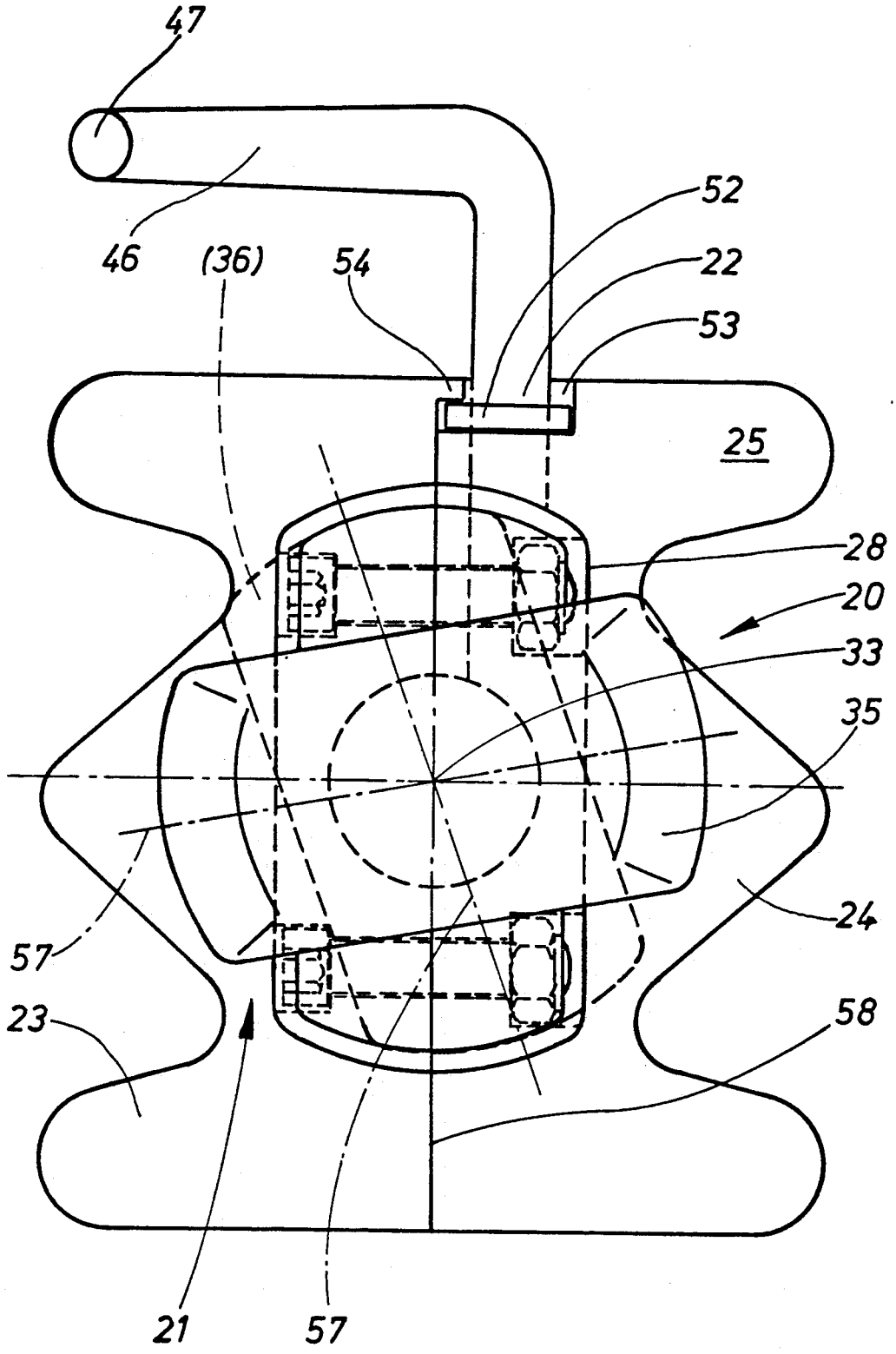
FIG. 3 shows a top view of the coupling piece according to FIG. 1.

The actuating lever 22 is now brought by means of the handle 46 into the locking position, that is to say pivoted into the plane of the abutment 25, as shown in FIG. 3. The switch nose 45 is then in the position which can be seen in FIG. 7. The upper crossbar 35 now forms an angle of 80° with the middle piece 28, while the lower crossbar 36 extends at 60° relative to the middle piece 29. During the lowering of the upper container onto the lower container, on the upper corner fitting 26 of the lower container the lower crossbar 36, as a result of its corresponding helical winding, is rotated, together with the locking bolt 21, back into the prelocking position shown in FIG. 4 once again counter to the prestress of the tension spring 41, until the upper container is lowered completely onto the lower container, as a result of which the tension spring 41 rotates the locking bolt 21 back into the locking position, in which the upper crossbar 35 forms an angle of 80° with the middle piece 28 and the lower crossbar 36 is at 60° relative to the middle piece 29. This switch position of the coupling piece is shown in FIGS. 3, 5, 6 and 7.

In order to release the coupling piece, it is necessary to move the actuating lever 22 back into the releasing position according to FIG. 4 manually by means of the handle 46. In this way, the lower crossbar 36 comes into coincidence with the middle piece 29, whilst, as before, the upper crossbar 35 extends offset relative to the middle piece 28, in particular at an angle of 20°.

In this switch position corresponding to the prelocking position of the coupling piece, the upper container together with the coupling piece can be lifted off from the lower container in order to break the connection. Once again, the coupling piece is detached from the lower corner fitting 27 of the upper container by rotating the locking bolt 21 on the lower crossbar 36, specifically through 20°, with the result that the upper crossbar 35 comes into coincidence with the middle piece 28, so that the coupling piece can be pulled out of the lower corner fitting 27 of the upper container.

After the locking bolt 21 has been let go, the coupling piece is then once again in the initial position according to FIG. 4, that is to say is ready for the next locking operation.

The coupling piece of the second exemplary embodiment (FIGS. 12 and 13) differs from the above-described coupling piece in an (elongate) indicator tongue 60 of approximately rectangular cross-section which is movable to and fro in the housing 20. The dimensions of the base area of the indicator tongue 60 are such that it is movable completely into the housing 20. As can be seen above all in FIG. 12, the indicator tongue 60 is arranged in the abutment 25 of the housing 20 in such a way that the indicator tongue 60 is movable to and fro freely between the mutually superposed corner fittings 26 and 27 of containers placed on one another.

For moving the indicator tongue 60 to and fro in the housing 20 there is a flexible movement member which, in the present exemplary embodiment, is designed as a wire rope 64 transmitting both tensile and compressive forces in relation to the longitudinal axis. This wire rope 64 is fastened at one end 61 by suitable means to that end region of the indicator tongue 60 pointing towards the interior of the housing 20, whilst the opposite end 65 of the wire rope 64 is connected to the locking bolt 21, specifically by means of a fastening strap 66 pointing outwards radially relative to the longitudinal mid-axis 33 of the locking bolt 21.

Here, the wire rope 64 for actuating the indicator tongue 60 is surrounded by an elastically deformable sheathing, in particular a compression spring 63. The compression spring 63 guides the wire rope 64 in a part annular space 62 formed inside the housing 20 and located between the outer circumference of the locking bolt 21 and an inner wall 67, approximately parallel to this, of the housing 20.

That end of the compression spring 63 directed towards the indicator tongue 60 is supported on a stop face 59 inside the housing 20. In contrast, that end of the compression spring 63 directed away from the indicator tongue 60 rests against the fastening strap 66 of the locking bolt 21. The compression spring 63 serving as a sheathing for the wire rope 64 performs a further function, in that, instead of the tension spring 41 of the first exemplary embodiment (FIG. 6), it causes a return movement of the locking bolt 21 for the purpose of a semiautomatic operation of the coupling piece, so that the switch nose 45 on the actuating lever 22 on the one hand and the projection 39 on the locking bolt 21 on the other hand rest against one another.

Figure 12:
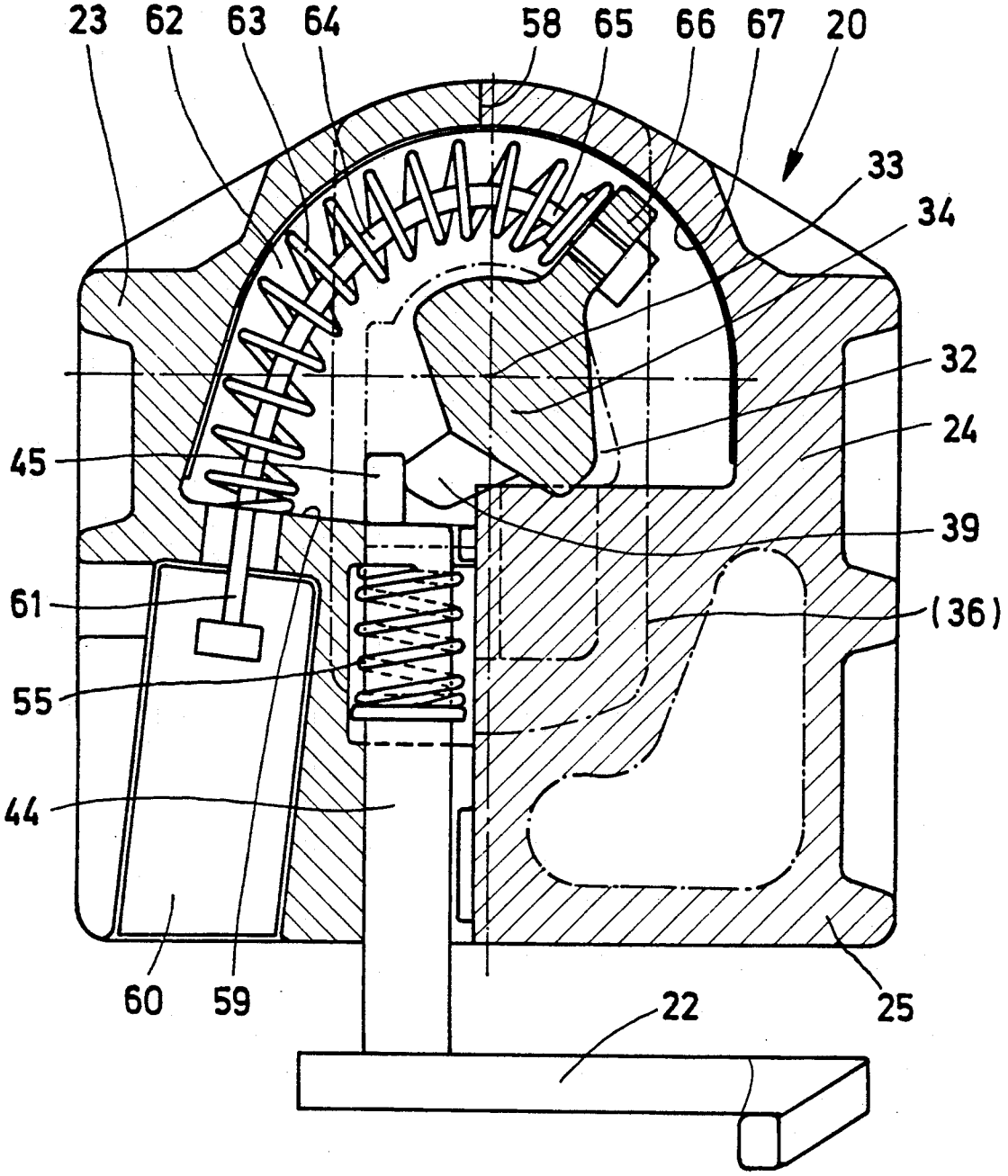
FIG. 12 shows a horizontal section XII-XII, similar to FIG. 1, but through a coupling piece according to a second exemplary embodiment.
Figure 13:
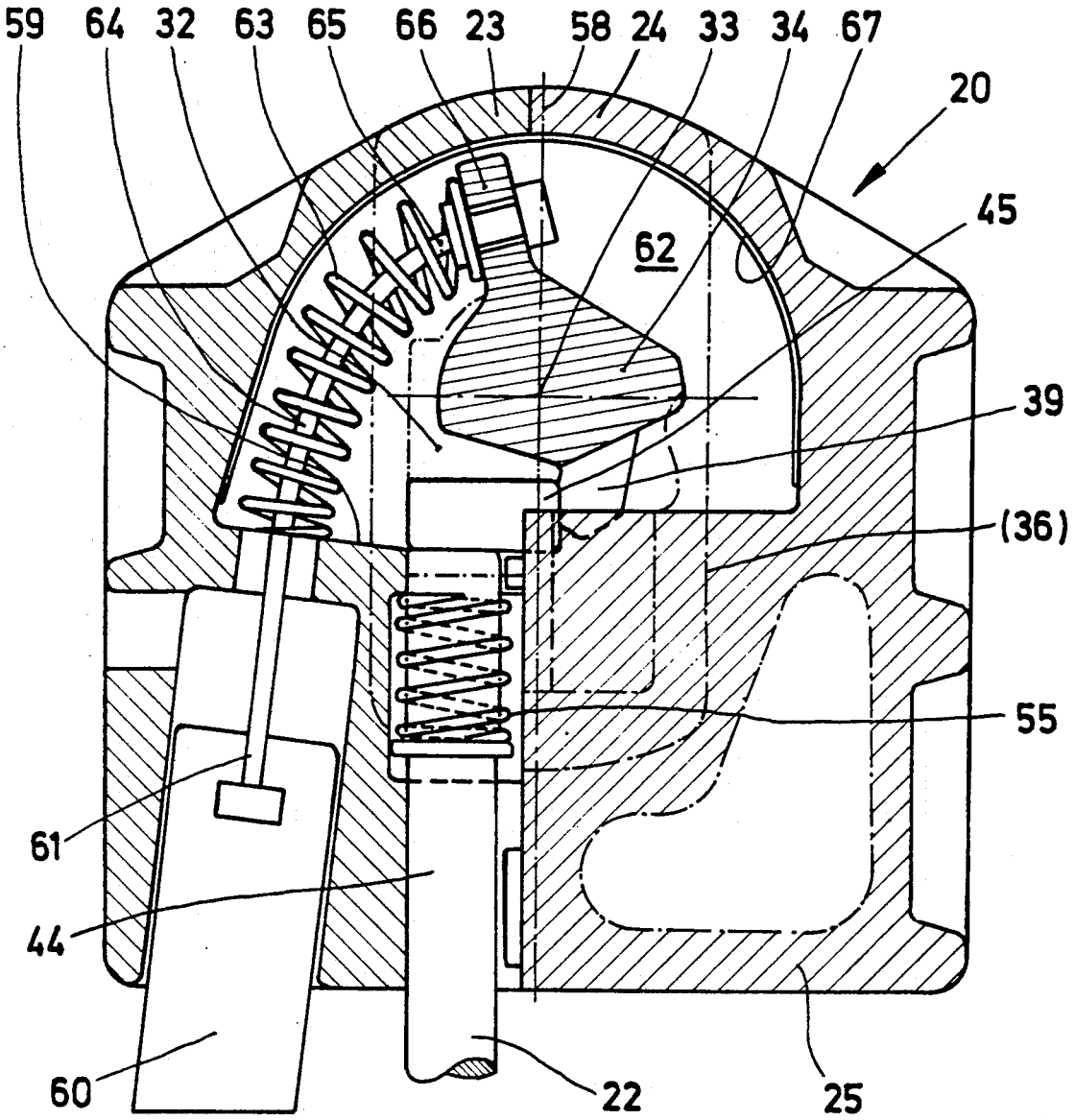
FIG. 13 shows the coupling piece in a representation according so that of FIG. 12, in the released state.

In the position of the locking bolt 21 shown in FIG. 12, corresponding to the locking position of the two crossbars 35 and 36, the indicator tongue 60 is retracted completely into the housing 20, that is to say is not visible from outside. In contrast, FIG. 13 shows a releasing or prelocking position of the coupling piece, in which at least one of the two crossbars 35 or 36 is in a released position relative to the corner fittings 26 and 27 of the containers. In this case, the indicator tongue 60 is partially extended from the housing 20 and the abutment 25 by means of the wire rope 64 actuated by the locking bolt 21. The length of that region of the indicator tongue 60 protruding from the abutment 25 or the housing 20 is calculated in such a way that at least part of this exposed region of the indicator tongue 60 projects out of a vertical plane formed by corresponding side walls of superposed containers. In the completely or partially unlocked state of the coupling piece, the indicator tongue 60 is therefore immediately visible when one looks from above into a gap between the mutually confronting side walls of adjacent container stacks.

To improve the visibility of that region of the indicator tongue 60 protruding from the abutment 25 of the housing 20, the indicator tongue 60 is at least partially in color contrast to the coupling piece, especially the housing 20 of the latter. Preferably, for this purpose, the entire indicator tongue 60 is provided with a conspicuous color coating. In the simplest case, this color coating can have a signal-red color shade. However, bright fluorescent colors are especially suitable for the color coating.

We claim:

1. A coupling piece for releasably connecting adjacent containers, comprising:

a housing:

a rotatable locking bolt positioned within the housing and having a longitudinal axis, said locking bolt including a crossbar located at each end thereof;

a rotatable actuating lever including a central axle portion mounted in the housing, said central axle portion having a longitudinal axis that is transverse with respect to the longitudinal axis of the locking bolt, said actuating lever being rotatable about the longitudinal axis of the axial portion;

spring means connected to said locking bolt for normally urging said locking bolt in a locking direction, said locking bolt being engaged by a portion of said actuating lever so that upon rotation of the actuating lever in a first direction about the longitudinal axis of the axle portion, said locking bolt is rotated in a releasing direction which is opposite to said locking direction to rotate said crossbars from the locking position to a releasing position.

2. The coupling piece according to claim 1, wherein said spring means is a tension spring and said locking bolt includes a middle part to which the crossbars are attached, said tension spring being connected to an inner wall of said housing and to said middle part.

3. The coupling piece according to claim 2, including a switch nose extending from one end of the actuating lever and located in the housing, said switch nose extending substantially parallel to the longitudinal axis of the locking bolt when the crossbars are in the locked position and extending substantially transversely to the longitudinal axis of the locking bolt when at least one of the crossbars is in the released position.

4. The coupling piece according to claim 1, wherein said actuating lever includes a switch nose connected to one end of the axle portion, said switch nose being the portion of the actuating lever that engages the locking bolt for rotating the locking bolt upon rotation of the actuating lever.

5. The coupling piece according to claim 4, wherein said switch nose extends transverse to the longitudinal axis of the axle portion, said locking bolt having a switch slot formed therein into which said switch nose extends.

6. The coupling piece according to claim 5, wherein said locking bolt has a projection formed on one side of the switch slot, said projection having a contact face which the switch nose contacts when the actuating lever is moved in the first direction, said contact force having a depression formed therein into which fits the switch nose when the crossbars have reached the releasing position.

7. The coupling piece according to claim 5, wherein said locking bolt includes a middle part to which the crossbars are attached and in which the switch slot is formed, said locking bolt only being forced to rotate in the releasing direction as a result of rotation of the actuating lever.

8. The coupling piece according to claim 4, wherein said switch nose extends substantially parallel to the longitudinal axis of the locking bolt when the crossbars are in the locked position and extends substantially transversely to the longitudinal axis of the locking bolt when at least one of the crossbars is in the released position.

9. The coupling piece according to claim 1, including a handle connected to one end of the axle portion of the actuating lever, said handle being positioned outside the housing.

10. The coupling piece according to claim 9, wherein said handle has a longitudinal axis that is transverse to the longitudinal axis of the axial portion.

11. The coupling piece according to claim 1, including spring means for normally biasing the actuating lever in a direction opposite to said first direction.

12. The coupling piece according to claim 11, wherein said spring means for normally biasing the actuating lever in a direction opposite to said first direction is a torsion spring mounted on and encircling a portion of the axle portion.

13. The coupling piece according to claim 1, including means for preventing axial movement of the actuating lever relative to the housing.

14. The coupling piece according to claim 1, wherein at least one of the crossbars has helically wound windings on its outer periphery for automatically causing rotation of that one crossbar from the locking position to the releasing position upon insertion of the one crossbar into a corner fitting of a container.

15. A coupling piece for releasably connecting adjacent containers, comprising;

a housing;

a locking bolt rotatably mounted within the housing and including a crossbar located at each end thereof, said crossbars being alternatively movable between a locking position and a releasing position, indicator means which is axially movable in response to movement of the crossbars for indicating the position of the crossbars; and flexible means for connecting said locking bolt to said indicator means.

16. The coupling piece according to claim 15, wherein said housing includes an intermediately positioned abutment portion that is adapted to rest between adjacent containers connected together by the coupling piece, said indicator tongue being positioned in a recess in the abutment and being axially movable such that when the crossbars are in the locking position the indicator means is positioned completely within the recess in the abutment, and when the cross bars are in the releasing position the indicator means protrudes outwardly from the outer periphery of the abutment.

17. The coupling piece according to claim 16, wherein said means for connecting extends in a plane transverse to the longitudinal axis of the locking bolt.

18. The coupling piece according to claim 17, wherein one end of the connecting means is connected to the indicator means and the opposite end is connected to a fastening strap which extends outwardly from the outer periphery of the locking bolt.

19. The coupling piece according to claim 15, wherein said connecting means includes a flexible wire rope and a compression spring which encircles the wire rope, said compression spring being position between an inner wall of the housing and the locking bolt to normally bias the locking bolt to position the crossbars in the locking position.

20. The coupling piece according to claim 15, wherein said indicator means is color coated to contrast with the color of the housing.

21. The coupling piece according to claim 15, wherein one end of the connecting means is connected to the indicator means and the opposite end is connected to a fastening strap which extends outwardly from the outer periphery of the locking bolt.

* * * * *

UNITED STATES PATENT AND TRADEMARK OFFICE

CERTIFICATE OF CORRECTION

PATENT NO. : 5,012,560

DATED : May 7, 1991

INVENTOR(S) : Janke et al.

It is certified that error appears in the above-identified patent and that said Letters Patent is hereby corrected as shown below:

On the title page:

Item [73] Assignee, Change "United Kingdom" to --Fed. Rep. of Germany--.

In Column 10, line 46, change "position" to --positioned--.

Signed and Sealed this

Eleventh Day of May, 1993

*Attest:*

Michael K. Kirk

MICHAEL K. KIRK

*Attesting Officer*

*Acting Commissioner of Patents and Trademarks*